United States Patent [19]

Bacon et al.

[11] Patent Number: 4,529,571

[45] Date of Patent: Jul. 16, 1985

[54] SINGLE-RING MAGNETIC CUSP LOW GAS PRESSURE ION SOURCE

[75] Inventors: Frank M. Bacon; John P. Brainard; James B. O'Hagan; Robert J. Walko, all of Albuquerque, N. Mex.

[73] Assignee: The United States of America as represented by the United States Department of Energy, Washington, D.C.

[21] Appl. No.: 437,081

[22] Filed: Oct. 27, 1982

[51] Int. Cl.[3] ..... H01J 27/02

[52] U.S. Cl. ..... 376/144; 376/108; 250/423 R; 250/427

[58] Field of Search ..... 376/107, 108, 114, 115, 376/116, 117, 151, 144; 250/423 R, 426, 427

[56] References Cited

U.S. PATENT DOCUMENTS

| | | | |
|---|---|---|---|
| 2,211,668 | 8/1940 | Penning | 376/116 |
| 3,212,974 | 10/1965 | Leboutet et al. | 250/423 R |
| 3,371,205 | 2/1968 | Berry | 250/427 |
| 3,786,258 | 1/1974 | Schmidt | 250/84.5 |
| 3,833,829 | 9/1974 | Reifenschweiler | 376/117 |
| 3,890,535 | 6/1975 | Gautherin et al. | 250/423 R |
| 4,156,159 | 5/1979 | Takagi | 313/230 |
| 4,383,177 | 5/1983 | Keller et al. | 250/423 R |
| 4,447,732 | 5/1984 | Leung et al. | 250/427 |

OTHER PUBLICATIONS

"Intense Neutron Target Test Facility: A 200 kV, 200 mA dc, Deuterium Ion Accelerator", Bacon et al., IEEE Transactions on Nuclear Science, vol. NS-26, No. 1, Feb. 1979.

"Development Program for Cancer Therapy Neutron Source", Bacon et al., SAND 79-1272, Jun. 1979.

"Intense Neutron Source High-Voltage Power Supply Specifications", Reidel, SAND 80-1911, Aug. 1980.

"Intense Neutron Source Development for Use in Cancer Therapy", Bacon et al., IEEE Trans. Nucl. Sci., Apr. 1981.

"D-T Generator Development for Cancer Therapy", Bacon et al., SAND 80-1033, May 1980.

"A $10^{13}$/Second 14 MeV Neutron Generator for Cancer Therapy", Walko et al., J. Vac. Sci. Tech., Apr. 1981.

*Primary Examiner*—Charles T. Jordan
*Assistant Examiner*—Richard Klein
*Attorney, Agent, or Firm*—George H. Libman; Albert Sopp; Judson R. Hightower

[57] ABSTRACT

A single-ring magnetic cusp low gas pressure ion source designed for use in a sealed, nonpumped neutron generator utilizes a cathode and an anode, three electrically floating electrodes (a reflector behind the cathode, a heat shield around the anode, and an aperture plate), together with a single ring-cusp magnetic field, to establish and energy-filtering mechanism for producing atomic-hydrogen ions.

19 Claims, 4 Drawing Figures

SINGLE-RING MAGNETIC CUSP LOW GAS PRESSURE ION SOURCE

BACKGROUND OF THE INVENTION

The present invention relates generally to a low pressure ion source and more specifically an ion source for use in connection with an intense neutron source. The United States Government has rights to this invention pursuant to Contract DE-AC04-76DP00789 between Sandia National Laboratories and the U.S. Department of Energy (41 CFR §9-9.109-6(i)(5)(ii)(B)). This invention is partially sponsored by the National Cancer Institute under HEW Interaqency Agreement No. Y01-CO-60700 and HEW Grant No. R01-CA25156.

X-ray and gamma-ray radiotherapy has been used successfully for many years in the treatment of cancer. Rapidly dividing malignant cells are more susceptible to radiation damage than are normal cells. However, oxygen deficient cells, called hypoxic cells, are more resistant to radiation than are well oxygenated cells, and unfortunately, cells deep in a tumor are usually hypoxic. Since the radiation resistance of hypoxic cells is smaller for densely ionizing particles such as high energy protons or heavier nuclei called high LET particles (for Linear Energy Transfer) than for x-rays or gamma-rays, there is significant interest in using high LET radiation in cancer therapy.

High LET particles tend to lose energy very quickly in penetrating tissue, and even for very high energy particles the penetration distance is limited. This limitation can be circumvented by using neutrons with an energy above 10 MeV. Such neutrons can penetrate deeply into living tissue and produce high energy protons by interacting with indigenous hydrogen at the site of the tumor.

Two techniques are presently used to generate neutrons for cancer therapy. The first uses a high intensity localized source of neutrons, such as $^{252}$Cf, which is implanted surgically in the tumor site. This is an expensive process which requires at least minor surgery and greatly limits the number of patients who can be treated with one source of neutrons. The second technique makes use of a device that generates neutrons externally and directs a collimated beam of neutrons onto the tumor site. Cyclotron particle accelerators are used to generate neutrons for this purpose, but they are expensive and difficult to use.

An alternative is to use the nuclear reaction between tritium and deuterium to form $^4$He and a 14.5 MeV neutron. These neutrons are produced by deuterium and tritium nuclei colliding at energies of a few hundred keV. The neutron source can take the form of an ion accelerator which accelerates deuterium and tritium ions, produced in an ion source, to the appropriate energy after which they collide with a target containing deuterium and tritium and produce 14 MeV neutrons. Such a source might be made sufficiently small and intense to satisfy the mechanical and radiological requirements of a therapy machine, while being inexpensive enough for hospitals in key regional centers throughout the country.

Radiotherapists have determined that treatment times should last no more than 5 to 10 minutes, and that the neutron beam should be well collimated to limit exposure to healthy tissue. These limitations dictate that the neutrons emanate from a target area no larger than $10^{-3}m^2$ with an intensity of $1\text{-}2\times10^{13}$ neutrons/second at a source to tumor distance of 1.25m. The machine would also need to be designed for use by non-technical hospital staff. Characteristics of an accelerator that would produce the required neutron output are a 200 mA beam of deuterium and tritium ions accelerated to 200 keV. A target capable of dissipating 40 MW/mz over an area of $1\times10^{-3}m^2$ is essential, as is an ion source which is capable of producing a high purity plasma dense enough to supply the required ion current and have a plasma density distribution conducive to proper beam extraction and focussing.

A neutron source satisfactory for use in cancer therapy should produce 14 MeV neutrons from the $T(d,n)^4He$ reaction at a rate of $1\times10^{13}$ neutrons per second and have an operational lifetime of at least 100 hours. Other applications for such a neutron source are in the areas of neutron activation, radioactive isotope production, and neutron radiography. A similar tube could be used to produce 2.5 MeV neutrons from the $D(d,n)^3He$ reaction at a rate of $10^{11}$ neutrons per second with an operational lifetime of 100 hours and would be useful in neutron radiography. For cancer therapy, the neutron source should be sufficiently compact for installation inside a rotatable neutron shield and collimator assembly in order to provide radiation onto the patient from different angles.

Earlier neutron sources have insufficient output, have an output that decreases with operating time, are inefficient from a power standpoint, or are otherwise impractical for use in a hospital. For instance, U.S. Pat. No. 3,786,258 to Schmidt describes a closed system, sealed-off neutron generator tube for generating 14 MeV neutrons from the $T(d,n)^4He$ nuclear reaction onto a deuterium and tritium absorption loaded target onto which accelerated deuterium and tritium gas ions are impinged. The system of U.S. Pat. No. 3,786,258 uses an annular ion source built around an axial target. In order to protect the ion source from neutron irradiation for some applications and to suppress secondary electrons produced by an ion beam striking the target and background gas, applicants have developed an ion source wherein the ion source is linearly disposed with respect to the accelerator and target and operates at low pressures.

In some applications, such as neutron radiography, displacement of the ion source from the target by about one meter is advantageous in that shielding material can be placed between the neutron source and ion source. This shielding reduces the amount of neutron radiation to the ion source and the resultant activation (radioactivity) of the ion source. Such an arrangement facilitates ease of maintenance on the ion source because of the reduced health hazard.

This one meter separation between target and ion source is not practical for medical applications because of the importance in maintaining the size of the neutron source as small as feasible. However, secondary electron suppression is important. Without secondary electron suppression, the current in the accelerator would be 200 mA of ion beam current plus 400 to 600 mA of secondary electron current. The secondary electrons striking the ion source create an additional 80 to 120 kW of heating power which has to be dissipated.

Ion sources can generally be classified as high pressure or low pressure sources. High pressure sources operate in the pressure range greater than 50 millitorr and require a uranium hydride reservoir to maintain the pressure and gas flow. High pressure sources have the disadvantage that they operate at a different pressure from their associated accelerators and require high speed vacuum pumps to maintain the pressure differential between the two regions. High pressure sources also have a disadvantage in that they require a higher tritium content than do low pressure sources.

Low pressure ion sources operate in the range of about 1–3 millitorr. With these sources, zirconium hydride reservoirs can maintain the low pressure levels required with no appreciable gas flow. Low pressure sources are much safer than high pressure sources because uranium, on exposure to air, spontaneously liberates tritium, whereas zirconium, if exposed to air, does not liberate its tritium and, therefore, is more acceptable for use in a hospital environment. In addition, since low pressure sources operate at the same pressure as the accelerator, no additional high speed pump is required.

SUMMARY OF THE INVENTION

It is therefore an object of the invention to provide a low pressure ion source.

It is further an object of the present invention to provide a low pressure ion source which works at approximately the same pressure as its associated accelerator.

It is a still further object of the present invention to provide a low pressure ion source that uses a low tritium content tube compared to a high pressure ion source.

It is also an object of the present invention to provide an ion source that is simple to operate.

It is another object of the present invention to provide a highly efficient ion source.

It is still another object of the present invention to provide a source which delivers over 200 mA of ion current uniformly over a 1.25 $cm^2$ aperture of over 50% atomic ions with about a 10A arc current.

It is a further object of the present invention to provide an ion source separated from the target of the ion beam by shielding.

It is a further object of the present invention to provide an ion source in a neutron generator which provides for secondary electron suppression.

In accordance with the present invention, a low pressure ion source for a neutron generator is provided. The source contains a cathode for generating electrons and an anode for removing the electrons. In addition, the source comprises electrodes at other potentials for confining a plasma created by arc current through the gas within the source. The source is enclosed in a vacuum envelope having an aperture for emitting an ion beam. A magnet is used to form a magnetic field for containing the electrons. It is by the interactions between the electrons and the gas that the ions are generated.

The cathode of the present invention may preferably consist of either a spiral filament or a plurality of serpentine filaments.

The ion source of the present invention will preferably provide a collimated ion beam having an ion current density of about 200 mA over an aperture of about 1.25 $cm^2$ with an anode to cathode potential of about 150 V and an arc current of about 10A.

Preferably, the magnet of the present invention will be formed from a ring of rectangular magnets radially disposed about a central axis with like poles facing the axis. The axial position of the magnetic ring may be fixed or may be adjustable to maximize the ion beam at the aperture and will preferably have a field strength of about 4 kG at the surface of the magnets.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and which form a part of the specification, illustrate the presently preferred embodiments of the invention and, together with the description, serve to explain the principles of the invention. In the drawings.

DETAILED DESCRIPTION OF THE INVENTION

Reference will now be made in detail to the present preferred embodiment of the invention, an example of which is illustrated in the accompanying drawings.

Figure 1:
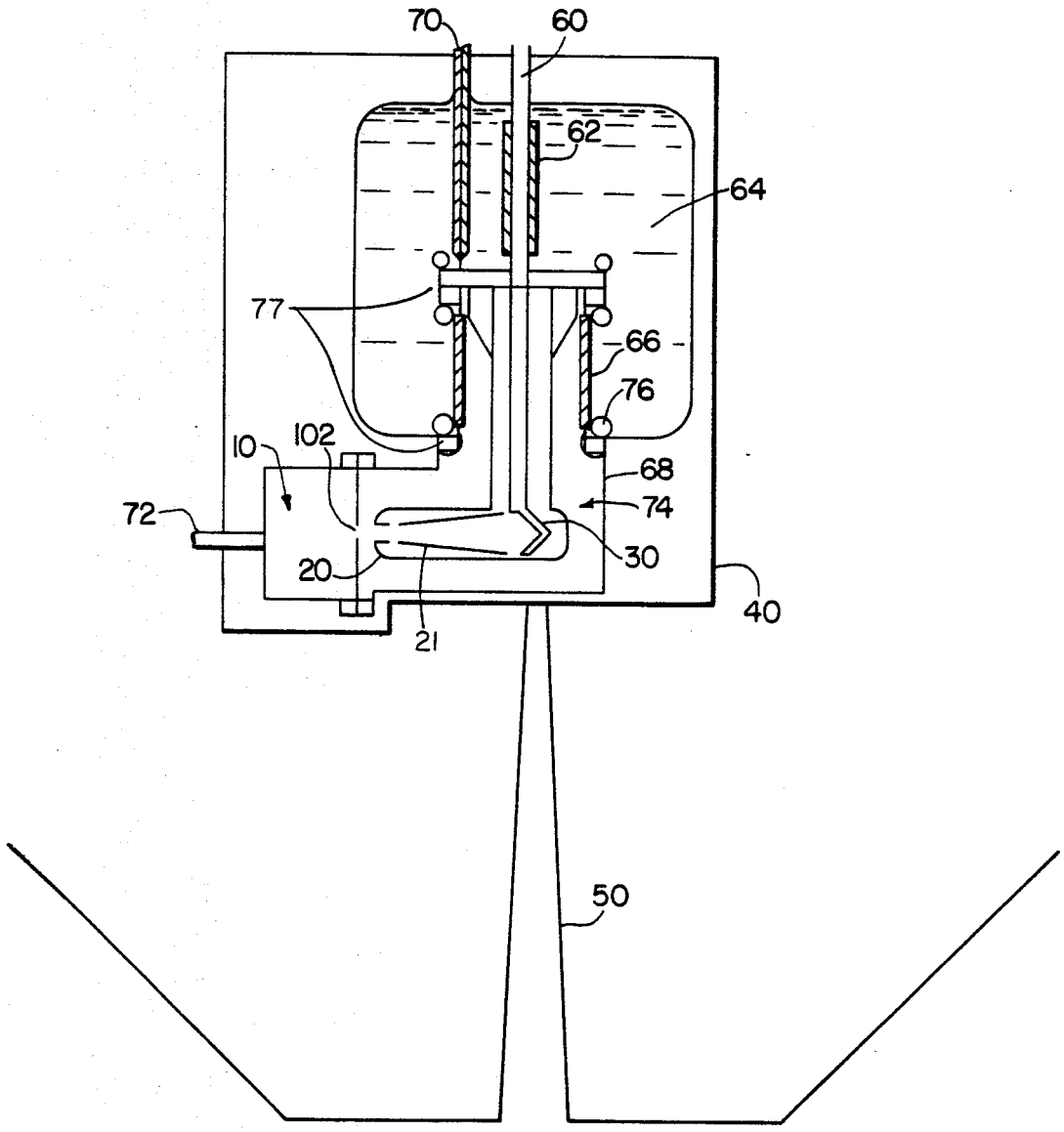
FIG. 1 is an elevation, showing a schematic of a neutron source utilizing the ion source of the present invention.

Turning first to FIG. 1 thereof, there is illustrated a neutron tube or source ittilizing the ion source of the present invention. The ion source is generally indicated at 10. Aligned with the exit aperture 102 of the ion source is an extractor electrode or accelerator 20. The accelerator is designed to accelerate the ion beam to an energy of about 200 keV with ion optics designed to cause the ion beam to impinge on the target 30 within an area of about 10 $cm^2$. The ion beam has a generally uniform ion current density across the exit aperture 102 of the ion source. The exit aperture will typically be on the order of 1.25 $cm^2$.

The extractor electrode 20 is biased negative about 4 kV with respect to target 30 so that electrons produced between the aperture of electrode 20 and target 30 will not enter the high field region between the ion source and extractor electrode. Electrode 21 is electrically tied to target 30.

Residual impurities in the ambient gas in the vacuum chamber 74 can interact with the target 30 to reduce the neutron output. $^3He$ gas may be formed inside the neutron source due to the radioactive decay of tritium and can become a significant impurity in the ion beam if not pumped away. Therefore, a vacuum pump specific to the impurities may be added to the neutron source to reduce these impurities to a sufficiently low level so that no neutron output degradation occurs.

A deuterium/tritium reservoir may be used to store the deuterium and/or tritium gas in a metal hydride when the source is not in use. When the neutron source is in operation, the reservoir is heated to outgas the hydrogen gas mixture for introduction into the ion source 10 and neutron tube as described below.

The target 30 preferably consists of a high temperature hydride target that produces neutrons efficiently and is capable of withstanding high power density ion beam bombardment. The target and accelerator may be similar to those described in IEEE Transactions on Nuclear Science, Vol. NS-26, No. 1, February 1979, "Intense Neutron Source Target Test Facility" by F. M. Bacon and A. A. Riedel and in IEEE Transactions on Nuclear Science, April 1981, "Intense Neutron Source Development for Use in Cancer Therapy" by F. M. Bacon et al, and in Report No. SAND80-1033, May 1980, "D-T Neutron Generator Development for Cancer Therapy", 1980 Annual Progress Report by F. M. Bacon et al. In addition, reference may be made to Report No. SAND79-1272, dated June 1979, entitled "Development Program for Cancer Therapy Neutron Source" by F. M. Bacon et al for further information regarding the neutron source and the target.

The ion source 10, accelerator 20 and target 30 are all encased in a vacuum envelope 68. Neutrons exit from the target into a neutron collimator 50. The entire neutron source is encased in a hermetically sealed canister 40 which acts as a secondary container for tritium in the event of a leak in the vacuum envelope. The target 30 and the ion source 10 are cooled; the target by a circulating coolant 60 and the ion generator by a coolant bath which may also circulate. The cooling water should preferably be insulated with insulator 62 from the oil bath 64 which surrounds the neutron source. High voltage insulator 66 is used to insulate the vacuum space 74 from the oil filled chamber 64. Electric field grading rings 76 are used to reduce the electric field strengths at the corners of the flanges 77 attached to the insulator. Power cables 72 are used to supply power to the cathode and anode of the ion source as further described hereinbelow. Negative high voltage cable 70 is used to energize the extractor electrode (accelerator) 20. Electrode 21 and target 30 are both at the same potential which is positive relative to the potential of electrode 20. Any electrons created by the beam in the vicinity of the target are repelled by the potential of electrode 20 and will not strike the ion source 10 or the high voltage insulator 66.

The target 30, when struck by the ion beam, produces neutrons which exit through collimator 50. It should be understood that the neutron beam for purposes of cancer treatment must be capable of being precisely aimed at the target exterior to the neutron tube. To this end, the collimator 50 may be embedded in a rotatable shield (not shown) which can rotate to aim the neutrons as desired.

Figure 2:
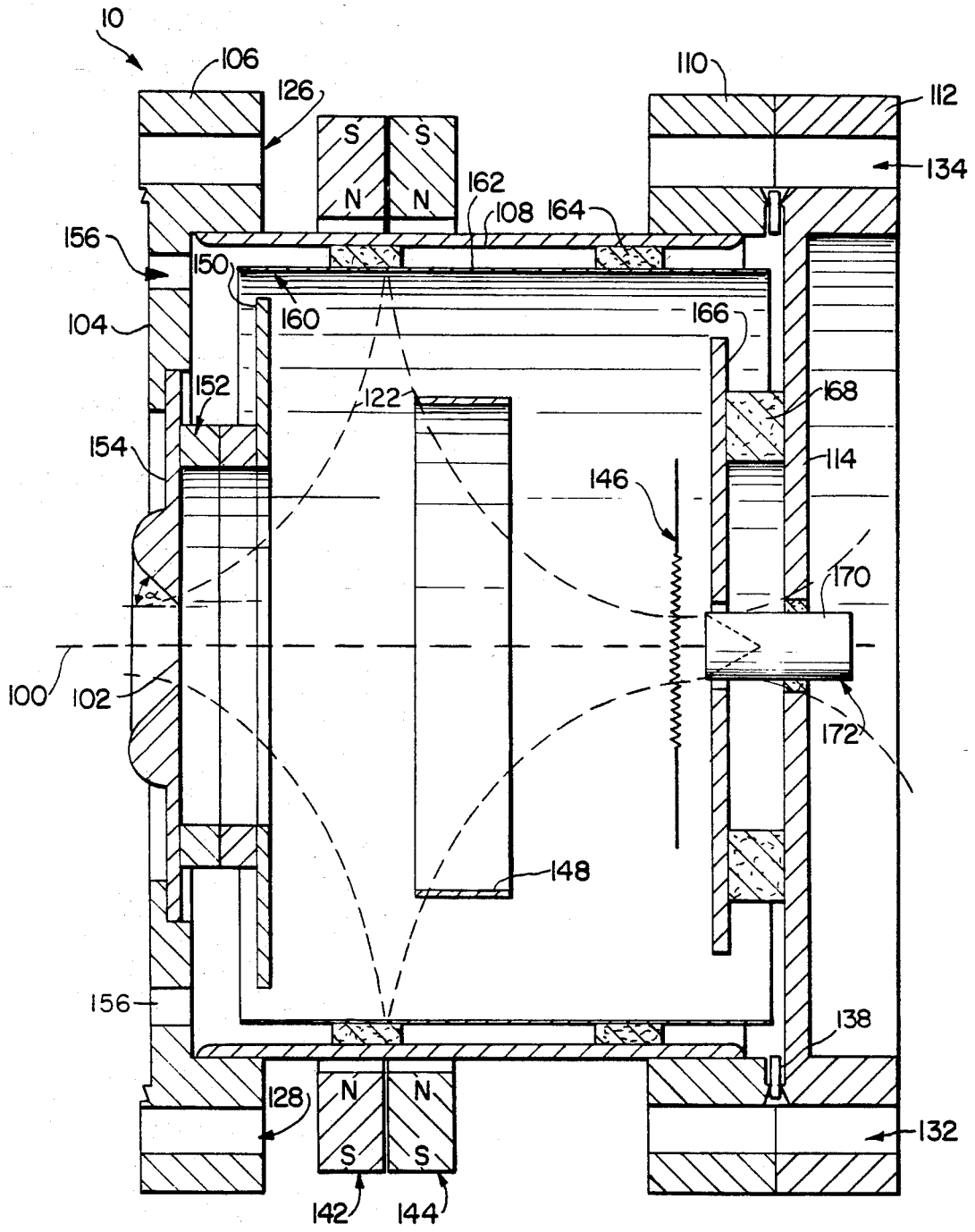
FIG. 2 is a schematic elevation of an ion source in accordance with the present invention.

Turning now to FIG. 2, there is depicted an ion source in accordance with the present invention. The source comprises a vacuum envelope consisting of front plate 104, sidewall 108 and rear plate 114. The various members are held together with vacuum flanges 106, 110 and 112. Vacuum flange 106 has bores 126 and 128 therein to facilitate attachment to the ion beam accelerator of FIG. 1. The vacuum flanges 110 and 112 are bolted together through bores 132 and 134 around the copper gasket 138 to provide an ultra-high vacuum seal, thereby allowing access to the inside of the ion source. The non-magnetic vacuum envelope is preferably formed of stainless steel.

Although the source is illustrated in the preferred embodiment as having a cylindrical cross-section, it is understood that FIG. 2 could represent cross-sections of other geometries employing this invention.

Surrounding the ion source 10 are one or more magnetic rings 142 and 144. These rings are preferably formed by assembling a series of permanent bar magnets, with each magnet having the same pole arranged to face radially inward toward the axis 100 of the ion source. The rings are used to form a single-ring cusp magnetic field (as exemplified by the dashed magnetic field lines 122) for confining the electrons and, therefore, for restricting the ions generated in the ion source away from the walls. The cathode 146 is supplied with a heating current from a 12 V, 100A power source, not shown, to make it function as an electron emitter.

Spaced radially inwardly from the vacuum envelope and axially between the cathode 146 and the exit aperture 102 is a ring anode 148 which functions as a positive electrode to remove electrons in the arc discharge. The anode ring 148 is held firmly in place by feedthrough supports (not shown) and is made of a conductive, non-magnetic refractory material such as molybdenum, tungsten or tantalum. A potential of about 150 V may be imposed between the anode and cathode with an arc current of about 10A.

Other cross-sections of anode rings are contemplated to reduce ion losses caused by plasma potentials which are greater than the anode potential. For example, an annular anode might have an oval cross-section with the major axis of the oval forming an angle with axis 100.

Spaced inwardly from the front wall 104, and preferably made of molybdenum, is aperture plate 150. In the preferred emobodiment shown, the plate 150 is spaced from the focus electrode 154 by non-magnetic, electrically conductive spacers 152. The spacers 152 are preferably made of stainless steel or molybdenum and the electrode 154 is preferably made of molybdenum. Alternatively, aperture plate 150 and focus electrode 154 could be combined into a single molybdenum plate. The shape of the exit aperture 102 formed by the focus electrode 154 is designed to focus and collimate the ion beam. It has been found that a focus electrode having an exit nozzle which angles away from the axis 100 of the ion source at an angle $\alpha$ of about 45° provides good focussing and collimation.

The front plate 104 contains an annular ring of equalization holes 156 to provide a return path for the gas pumped out by the operation of the ion source. The gas can enter from the accelerator or reservoir area through aperture 102 or through holes 156 into the source by the space between spacers 152 or by the space 160 between aperture plate 150 and heat shield 162.

The heat shield 162, preferably made of the same material as the anode 148, is spaced from the side walls by insulating spacers 164.

Between the cathode 146 and back plate 114 is a reflector plate 166 of molybdenum or similar material, spaced from the back plate by inert spacers 168 preferably made of alumina or boron nitride.

A beam catcher 170 is aligned on the axis 100 of the source opposite the exit aperture 102 in order to dissipate the energy in the electron beam that is created in the high field gap between the ion beam accelerator 20 and ion source 10. It will be understood that the beam catcher must dissipate a considerable heat load (from the low level secondary electrons which are not suppressed) and is, therefore, in contact with a cooling fluid along a portion 172 that extends outside of the source. The beam catcher is preferably made of molybdenum.

Both the heat shield 162 and the reflector plate 166 are electrically isolated from each other and from the focus electrode 154/aperture plate 150 since, for stability and efficiency, each is maintained at a different electrical potential by the plasma. The most positive electrode potential exists at the anode ring 148. The next most positive electrode potential is imposed on the aperture plate 150/focus electrode 154. A more negative potential is imposed on the cylindrical heat shield 162. More negative still is the reflector plate 166. Of course, the cathode 146 is at the most negative potential of any conductor in the source. Except for the cathode 146 and the anode 148, all of the electrode potentials are determined by the plasma floating potential. However, the potential of these electrodes may be controlled to optimize performance of the source.

During dperation the source 10 is fastened to an accelerator which has an associated reservoir of deuterium or tritium. When the reservoir is heated, gas is released which reaches an equilibrium pressure on the order of 1–3 millitorr, depending on temperature. The gas will fill the entire vacuum chamber so that when the cathode 146 is heated and the anode ring 148 energized, an electric discharge will be created between the anode and cathode. The power supply for the arc discharge may be a source of approximately 150 volts at 10–20 amps, dc. For ease in starting the arc discharge, 150Ω resistor is connected, externally to the vacuum chamber 108, between the anode 148 and vacuum chamber 108. The molecular gas, either $D_2$ or $T_2$, then becomes ionized and dissociated to yield atomic ions, $D^+$ or $T^+$, or molecular ions. These ions exit the aperture 102 (in a beam), pass through the accelerator and strike the target 30 to produce neutrons.

The polarity of the electric field outside of the source is such that electrons trying to exit the ion source are reflected back into the source and positively charged ions are extracted from the source to form an ion beam. According to the present invention, the target 30 can advantageously be located a meter or more away from the source which allows for shielding to be positioned between the neutron source and the ion source. This is especially important where it is critical that the ion source structure not become activated by energetic neutrons when ion source maintenance is necessary.

The reflecting plate 166 should he charged sufficiently negative to reflect most of the electrons generated by cathode 146, but it should not be so negative as to cause a discharge to anode ring 148. The cylindrical heat shield 162 performs a similar type of reflecting as the reflecting plate 166.

Figure 3A:
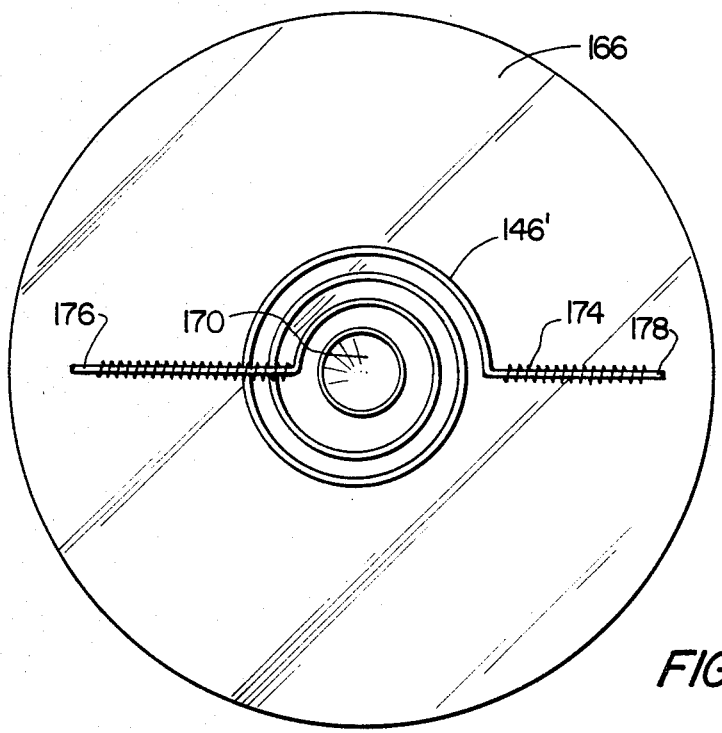
FIGS. 3A and 3B are fragmentary elevation views, illustrating various cathode structures of the ion source of FIG. 2.
Figure 3B:
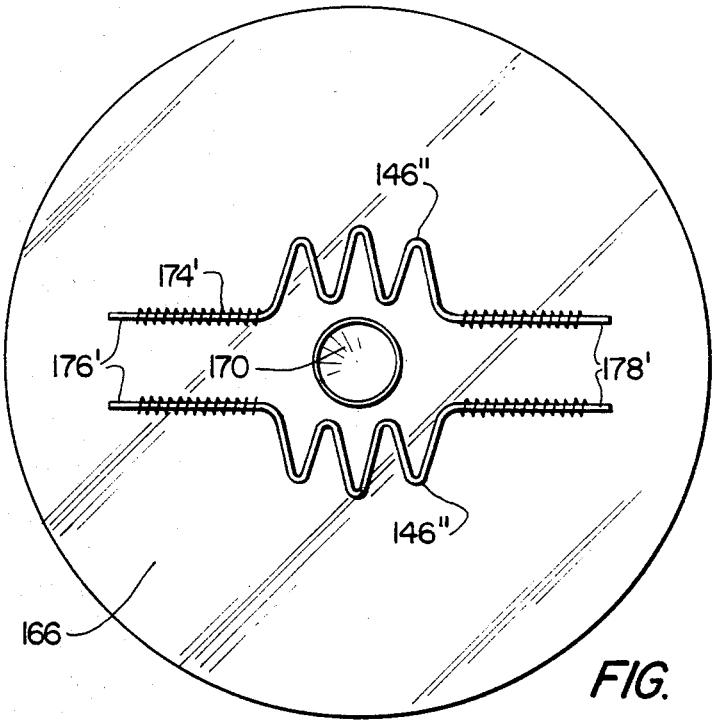

FIGS. 3A and 3B depict two arrangements for forming the cathode 146 of the source 10 of FIG. 2. In FIG. 3A, cathode 146' is formed as a spiral filament, preferably made of a non-magnetic, high temperature material such as tungsten or tantalum. Encasing the leads 176 and 178 are shorting wires 174 wound around the leads to prevent the filament from heating and emitting electrons. The spiral filament provides a surface area for electron emission within the magnetic field formed by magnetic rings 142 and 144 (FIG. 2). In addition, by maintaining the hot portion of the filament in the middle of the winding. the filament tends to get heated by the plasma as we11 as by the healing current.

FIG. 3 illustrates a second configuration for the cathode Comprised of a serpentine filament set 146''. Like the spiral filament, the serpentine filament surrounds the beam catcher 170 and is spaced from the reflector plate 166 to form a good electron source within the magnetic field formed by the magnetic rings 142 and 144 (FIG. 2).

It should be understood that the magnetic ring (which may comprise one or more rings as described hereinabove) is positioned near the anode ring 148. The magnetic field forms a single-ring magnetic cusp axially to the left of the anode such that the magnetic field touches the left edge of anode ring 148 as shown by lines 122 in FIG. 2. This arrangement enhances the output beam current and increases atomic ion production. The magnetic ring may be fixed or may be axially movable to permit peaking of the ion beam. The magnetic field (which should be on the order of about 4 kG at the surface of the magnet) coupled with the floating electrodes formed by the heat shield 162, the reflector plate 166 and the focus electrode 154 (each of which floats at a different potential as described hereinabove) contributes to the efficiency of the ion source.

This source takes advanatage of the fact that high energy electrons are necessary to form diatomic ions, and that low energy electrons are required to dissociate the diatomic ions into atomic ions. This two-step process is a very efficient means of producing atomic ions. The plasma is essentially at anode potenial and, therefore, drawn electrons from the cathode. These relatively high energy electrons are confined between the cathode and magnetic ring cusp when the plasma just grazes the anode ting as shown in FIG. 2. Electrons can move to the aperture plate side of the ring cusp only through scattering events which lower their electron energy. The device, therefore, serves as an energy filter for electrons.

The magnetic field has little effect on the ion motions because of the large mass of the ions. Diatomic ions are formed on the cathode side of the source by electrons with energies near 75 eV. These diatomic ions are then dissociated into atomic ions as they drift to the aperture plate where they are bombarded by electrons of approximately 15 eV. The high voltage accelerator 20 extracts the ions from the plasma boundary near the focus electrode.

The ion source, according to the invention, produces an ion current density that is uniform within 20 percent across the exit aperture. The source produces 200 mA of ion current through an aperture of 1.25 $cm^2$ with 150 V applied between the anode and cathode at an arc current of 10 A. The ion beam current is a linear function of the arc current. Atomic ions represent over 50 percent of the total ions.

When the ion source is operating and an ion beam is being extracted from it, the pressure within the ion source tends to drop since drawing ions from the source is similar to pumping gas from the source. Such pumping action can make the source operate unstably; especially at high ion currents. Therefore, the present invention provides an annular ring of pressure equalization holes 156 so positioned as to allow gas to flow back into the source from the accelerator region. The vent 160 and holes 156 are so positioned and shielded that plasma will not flow out through them thus producing unwanted ion beams. Typically the plasma density in the region of the vent 160 is less than 10 percent of the maximum plasma density which, coupled with the aperture plate 150, reduces to a very low probability the chance that ions will exit through holes 156.

It is important to note that the ion source of the present invention is intended to be compatible with an ultra high vacuum acceleration system. It is, therefore, important to prevent the source from generating impurities which could be drawn off into the accelerator and ultimately contaminate the target. With regard to the vacuum, it should be appreciated that the whole system, i.e. source, accelerator and target is in a vacuum chamber which is pumped down prior to use to a pressure of about $10^{-10}$ torr.

The foregoing description of a preferred embodiment of the invention has been presented for purposes of illustration and description. It is not intended to be exhaustive or to limit the invention to the precise form disclosed, and obviously many modifications and variations are possible in the light of the above teaching. For example, focus electrode 154 may be moved closer to anode ring 148 to increase the ion beam current. In addition, reflector 166 could be moved away from anode 148 to increase the electron mean-free path and lower the operating pressure of the source. This change might require an additional magnetic ring to prevent a magnetic pinch in front of the reflector. The illustrated embodiment was chosen and described in order to best explain the principles of the invention and its practical application and thereby enable others to best utilize the invention in various embodiments and with various modifications as are suited to the particular use contemplated. It is intended that the scope of the invention be defined by the claims appended hereto.

We claim:

1. A single-ring magnetic cusp low gas pressure ion source for a neutron generator, said source comprising:

a nonmagnetic housing comprising a rear plate and a front wall spaced from said rear plate, said front wall including an aperture plate having aperture means for passage of ions from said housing;

cathode means for emitting electrons positioned within said housing, said means being near and electrically insulated from said rear plate, an axis of said source extending from said cathode to said aperture means;

nonmagnetic anode ring means coaxially aligned with said axis and positioned between said cathode and said aperture plate for receiving electrons from said cathode when a positive voltage is applied between said anode and said cathode, said ring being electrically insulated from said cathode and housing;

a nonmagnetic cylinder coaxial with said axis within said housing and surrounding said anode, said cylinder being electrically insulated from said cathode and housing;

an electron reflector plate located between said cathode and said rear plate, said reflector plate being electrically insulated from said cathode, anode, housing and cylinder; and magnetic ring means for forming a magentic field having a continuous single-ring cusp on said cylinder said single-ring cusp being the only cusp formed on said cylinder, the magnetic field lines from said cathode to said cusp passing adjacent said anode ring; whereby electrons are confined between said cathode and said magnetic ring cusp, and ions can pass through said magnetic field to said aperture means.

2. The ion source of claim 1 wherein said reflector plate and said rear plate contain coaxially aligned holes; and beam catcher means passing through said holes for dissipating energy from secondary electrons.

3. The ion source of claim 1 wherein said housing further comprieses a tube extending from said rear plate to said front wall, said tube surrounding said cylinder, said magnetic ring means surrounding said tube; whereby said housing forms a vacuum chamber.

4. The ion source of claim 3 wherein said cylinder extends from near said rear plate to near said front wall, said cylinder forming a heat shield for said tube.

5. The ion source of claim 3 wherein said magnetic ring means comprises a magnetic ring surrounding said tube, said cusp being formed on said cylinder within said magnetic ring, and said magnetic field touching the edge of said anode closest to said front wall.

6. The ion source of claim 5 wherein said anode ring is spaced about equidistance from each of said rear plate and said front wall.

7. The ion source of claim 3, wherein said vacuum housing and said aperture plate contain passage means to vent gas from outside said envelope into said source.

8. The ion source of claim 1, wherein said magnetic ring means comprises a magnetic ring centered about said source axis.

9. The ion source of claim 8, wherein said magnetic ring comprises a series of permanent magnets, radially disposed about said axis with the same pole of each said magnets facing said axis.

10. The ion source of claim 1, wherein said cathode comprises a spiral filament.

11. The ion source of claim 10, wherein said filament has electrical leads with shorting wires wrapped around support ends to prevent electron emission.

12. The ion source of claim 11, wherein the filament is made of one of tungsten or tantalum.

13. The ion source of claim 1, wherein said cathode comprises at least one serpentine filament.

14. The ion source of claim 1, wherein the potential between the anode and cathode is about on the order of 150 V with an arc current of about 10A.

15. The ion source of claim 14, wherein the ion beam has an average current density of about 200 mA over an aperture of about 1.25 $cm^2$ and atomic ions comprise over 50 percent of the ion beam current.

16. The ion source of claim 1 wherein said aperture means includes a plate aperture in said aperture plate and a focus electrode electrically connected to said plate aperture and having an aperture axially aligned with said plate aperture.

17. The ion source of claim 16 wherein said aperture means is electrically connected to said housing.

18. The ion source of claim 16, wherein said exit aperture of said focus electrode is formed as a beveled opening diverging at an angle from said ion source.

19. The ion source of claim 18, wherein said angle is about 45°.

* * * * *